US008556311B1

(12) United States Patent
Lucero

(10) Patent No.: US 8,556,311 B1
(45) Date of Patent: Oct. 15, 2013

(54) TRUCK CAB AND BED LIFT TOOL

(71) Applicant: Marcos V. Lucero, El Paso, TX (US)

(72) Inventor: Marcos V. Lucero, El Paso, TX (US)

( * ) Notice: Subject to any disclaimer, the term of this patent is extended or adjusted under 35 U.S.C. 154(b) by 0 days.

(21) Appl. No.: 13/761,677

(22) Filed: Feb. 7, 2013

(51) Int. Cl.
*B66C 1/00* (2006.01)

(52) U.S. Cl.
USPC ..... 294/67.33; 294/67.3

(58) Field of Classification Search
USPC ..... 294/67.3, 67.33, 67.1, 67.2, 67.5, 294/81.1–81.4, 81.5, 81.54, 81.62, 90, 93, 294/94, 119.1
See application file for complete search history.

(56) References Cited

U.S. PATENT DOCUMENTS 1,769,134 A * 7/1930 Haff ..... 294/67.3
2,402,579 A 6/1946 Ross
2,801,124 A * 7/1957 Colby ..... 294/15
3,427,066 A * 2/1969 Kugler ..... 294/67.3
3,549,190 A 12/1970 Caldwell
3,804,207 A 4/1974 Stonebraker et al.
5,775,753 A * 7/1998 Tetelboim ..... 294/67.21
6,578,892 B2 * 6/2003 Tsimmerman ..... 294/67.21
2006/0261320 A1 11/2006 Crawford

OTHER PUBLICATIONS

Truck Bed Lifter. http://truck-bed-lifter.brunmfg.com/ Accessed on Dec. 13, 2011.
Steck Bed Lifter, Model # 35885. http://www.northerntool.com/shop/tools/product_200335202_200335202?cm_mmc=Aggregates-_-Google-_-Auto%20Repair%3EAuto%20Body%20Repair-_-111291 Accessed on Dec. 13, 2011.

* cited by examiner

*Primary Examiner* — Stephen Vu
(74) *Attorney, Agent, or Firm* — Motgomery Patent & Design; Robert C. Montgomery

(57) ABSTRACT

A truck cab and bed lift tool for removing cab and bed bodies from pickup truck frames. The tool includes a horizontal main beam having adjustable and configurable end appendages. Those appendages provide adjustable contact elements that mate with suitable lifting points of a pickup truck bed, cab structure, or other major body element. The main beam includes a heavy-duty hook that enables the truck cab and bed lift tool to be lifted by an engine hoist, overhead winch, or other suitable lifting mechanism.

14 Claims, 6 Drawing Sheets

TRUCK CAB AND BED LIFT TOOL

RELATED APPLICATIONS

There are no current co-pending applications.

FIELD OF THE INVENTION

The presently disclosed subject matter is for servicing pickup trucks and similar structures. More particularly, the present invention is a truck cab and bed lift tool having a horizontal main beam with adjustable and configurable end appendages that include adjustable contact elements that mate with lifting points of a pickup truck bed, cab structure, or other major body element. The truck cab and bed lift tool and the body component to which it is mated can be lifted by an external lifting mechanism.

BACKGROUND OF THE INVENTION

As anyone who performs a lot of mechanical work will attest to the fact that nothing beats having the proper tool for a particular job. The proper tool can save time, save money, produce a higher quality job, reduce damage to equipment, and provide for increased worker safety. The proper tool can convert a difficult, long, and dangerous job to a job that is easily and quickly accomplished.

One (1) field of work that uses a multitude of specialty tools is automotive bodywork. During such work it is often necessary to completely remove a body structure. Easily said, often very difficult to do. Pickup trucks often need to have their cab, truck bed, or other body part removed. These items are often very heavy, awkward, unbalanced, rusted, damaged, frozen in place or just unforgivingly difficult to remove from the rest of the vehicle. Making the problem even more difficult is that some body parts must be lifted using a limited number of specific contact points.

Lifting is typically performed using any of number of rather special lifts such as overhead cranes; cherry pickers; engine hoists and the like. While generating the power to lift a body part isn't difficult, lifting the right part using the right lifting points is challenging. This may require up to four people at one (1) time to make sure that the body structure is carefully staged, lifted and removed. This obviously represents a large cost that is not feasible for many smaller body shop operations.

In addition, placing new or repaired body parts on a truck is even more challenging in that improper lifting can damage an expensive body part and result in an unhappy customer.

Accordingly, there exists a need for a tool by which pickup truck body structures and other such structures can be easily lifted, removed, and replaced by one (1) person. Preferably such a tool would be useful for lifting truck bodies, truck cabs and other motor vehicle body parts with a reduced possibility of damage. Ideally such a tool would support vehicle contact plates that are adjustable in X-Y-Z axes while enabling balanced lifting. Preferably the contact plates would not mar the body finish and would be quickly adjustable.

SUMMARY OF THE INVENTION

The principles of the present invention provide for a truck cab and bed lift tool for lifting, removing, and replacing pickup truck body structures by one (1) person. The truck cab and bed lift tool can lift truck bodies, truck cabs and other motor vehicle body parts with little chance of damage. The truck cab and bed lift tool includes vehicle contact plates that are adjustable in X-Y-Z axes while enabling balanced lifting. The contact plates are configured to be non-marring and quickly adjustable.

The truck cab and bed lift tool comprises an overall "I"-shaped frame with adjustable end appendages. Those appendages are designed to provide either interior or exterior coupling points that grab onto pickup truck bed bodies, the cab structure of trucks, or other similar attachment areas using contact plates. The truck cab and bed lift tool is provided with a heavy duty hook that allows the truck cab and bed lift tool to be attached to engine hoists, overhead winches, or other suitable lifting mechanisms. In practice the truck cab and bed lift tool is approximately fifty-eight inches (58 in.) across and about twenty-six inches (26 in.) wide. Each adjustable end point is capable of another 12 inches of lateral movement as well as eight inches (8 in.) of downward movement and terminates in flat contact plates. Adjustments are accomplished by a "sliding leg" system with lockable adjustment pins. The truck cab and bed lift tool is useful with fleet side and step side pickup trucks. When not in use the truck cab and bed lift tool is easily stored in a small area. While very useful for trucks the truck cab and bed lift tool can also be used with other motor vehicles, particularly including cars.

A truck cab and bed lift tool that is in accord with the present invention includes a main beam having a first end and a second end, a "T"-shaped first upper extension adjustably extends horizontally from the first end, and a "T"-shaped second upper extension adjustably extends horizontally from the second end. An inverted "T"-shaped first lower extension adjustably extends vertically from the first upper extension while an inverted "T"-shaped second lower extension adjustably extends vertically from the second upper extension. A first telescoping outer extension adjustably extends horizontally from a first side of the first lower extension, a second telescoping outer extension adjustably extends horizontally from a second side of the first lower extension, a third telescoping outer extension adjustably extends horizontally from a first side of the second lower extension, and a fourth telescoping outer extension adjustably extends horizontally from a second side of the second lower extension.

The truck cab and bed lift tool further includes a first lift plate assembly adjustably extending horizontally from the first telescoping outer extension, a second lift plate assembly adjustably extending horizontally from the second telescoping outer extension, a third lift plate assembly adjustably extending horizontally from the third telescoping outer extension; and a fourth lift plate assembly adjustably extending horizontally from the fourth telescoping outer extension.

Beneficially, the main beam includes a central lifting hook and is comprised of open-ended, hollow structural steel tubing. The first upper extension main beam is beneficially also comprised of open-ended, hollow structural steel tubing that slides relative to the main beam and includes a vertically orientated open tube. A plurality of pin apertures is disposed in the first upper extension and a pin aperture passes through the main beam such that the pin apertures in the first upper extension can align with the pin aperture in the main beam. Also beneficially a first pin fastener passes through aligned pin apertures in the main beam and in the first upper extension, and a first rubber pad extends along the bottom of the main beam. Preferably the main beam is approximately fifty-eight inches (58 in.) long.

The vertically orientated open tube beneficially includes a pin aperture, while the first lower extension includes a plurality of pin apertures that selectively align with said the pin aperture of the vertically orientated open tube. A second pin fastener passes through the aligned pin apertures in the vertically orientated open tube and upper extension.

In practice the first lift plate assembly provides a horizontal, generally rectangular surface that is designed to mate with a lifting point of a pickup truck body. The first lift plate assembly can be adjusted in the X axes, the Y axes, and the Z axes. The first lift plate assembly preferably includes a second rubber pad.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
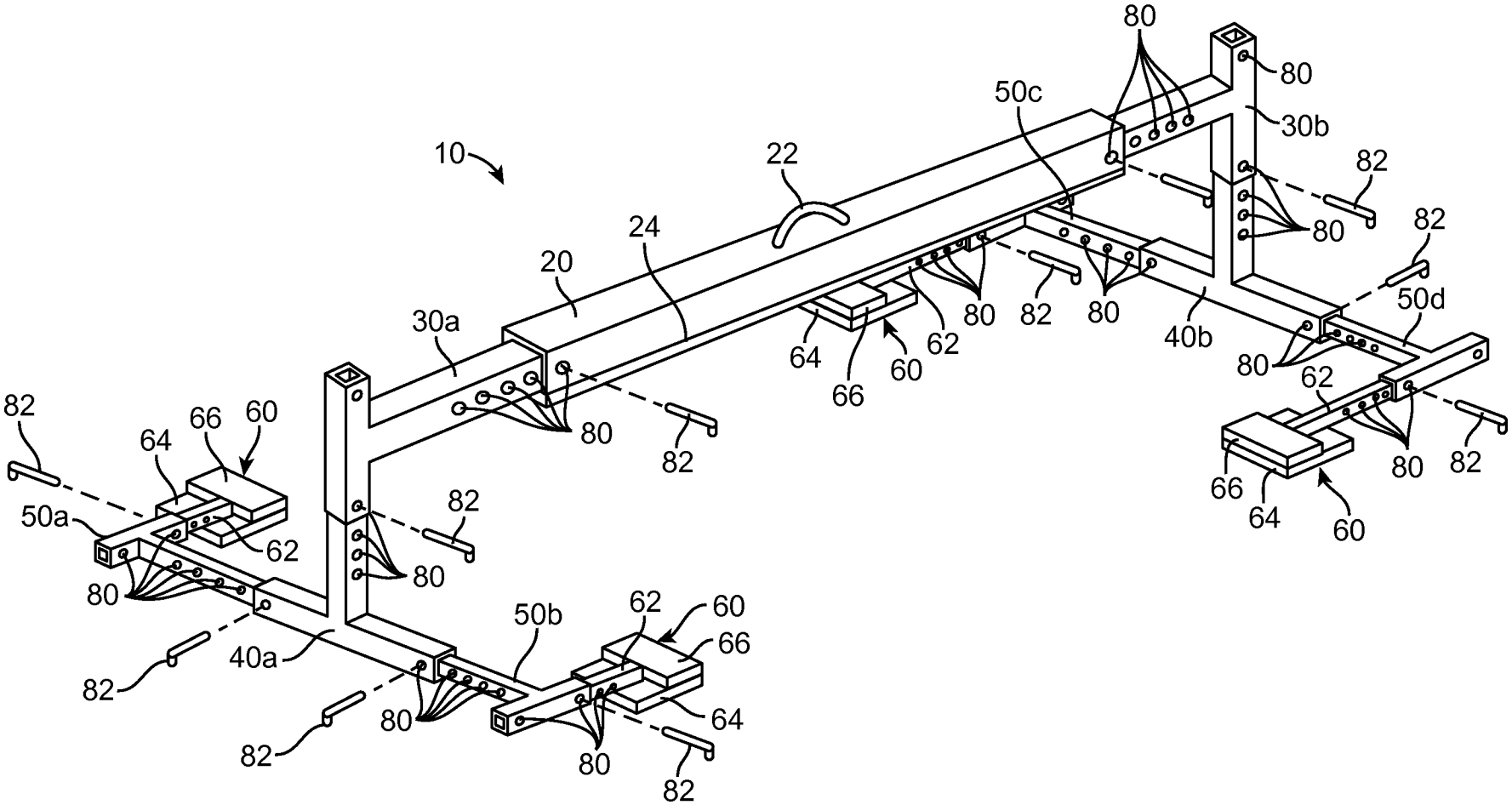
FIG. 1 is a perspective view of a truck cab and bed lift tool 10 according to a preferred embodiment of the present invention generally configured to remove a step-side pickup truck bed.

| | |
|---|---|
| 10 | truck cab and bed lift tool |
| 20 | main beam |
| 22 | lifting ring |
| 24 | first pad |
| 30a | first upper extension member |
| 30b | second upper extension member |
| 40a | first lower extension member |
| 40b | second lower extension member |
| 50a | first outer extension member |
| 50b | second outer extension member |
| 50c | third outer extension member |
| 50d | fourth outer extension member |
| 60 | lift plate assembly |
| 62 | extension bar |
| 64 | lifting plate |
| 66 | second pad |
| 80 | pin aperture |
| 82 | pin fastener |
| 95 | boom hoist |
| 97 | tripod-type hoist |
| 100 | pickup truck |
| 105 | step-side bed |
| 110 | cab |
| 115 | fleet-side bed |

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a truck cab and bed lift tool 10 for assisting removal of major body portions of pickup trucks 100 such as truck cab 110, a step-side bed 105, a fleet-side bed 115, and the like, from a frame. The truck cab and bed lift tool 10 includes a main beam 20 with joined telescoping members that are designed to support either interior or exterior lifting using suitable lifting points.

Figure 2:
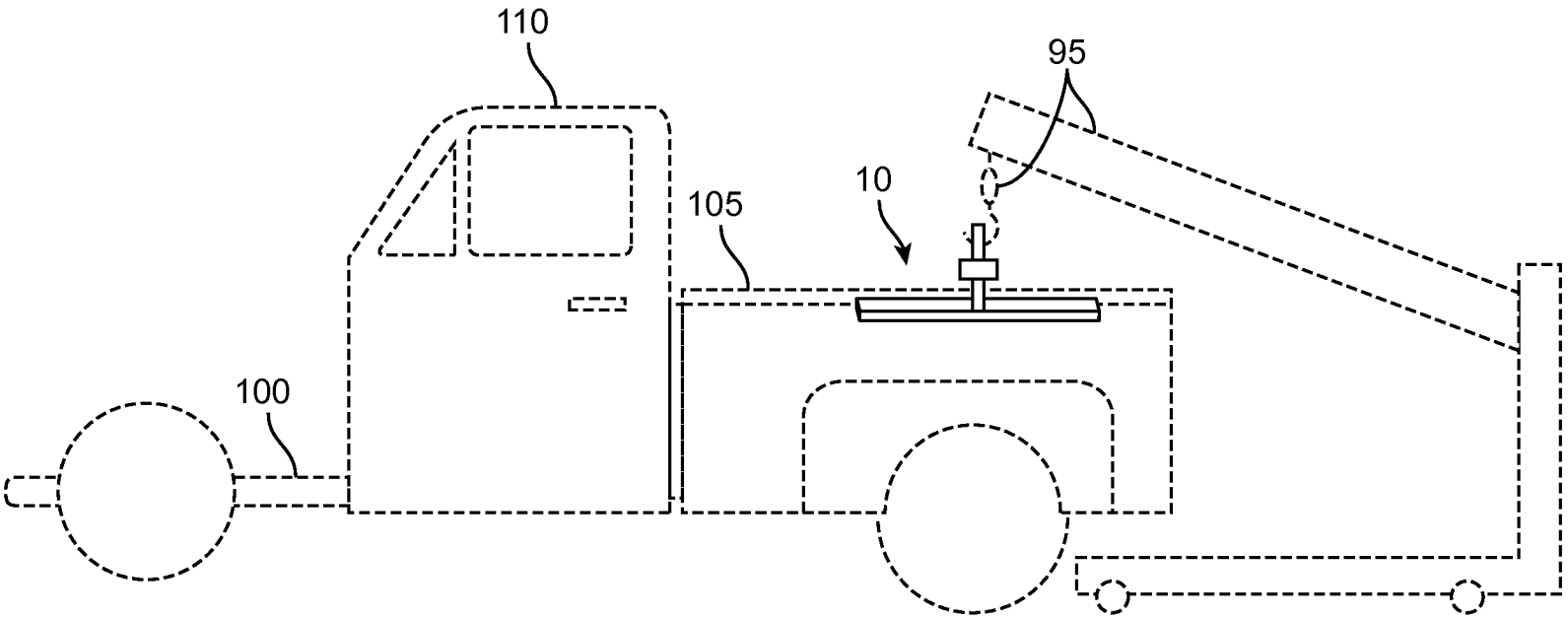
FIG. 2 is an environmental view of the truck cab and bed lift tool 10 removing a step-side pickup truck bed 105.

Refer now to FIGS. 1 and 2, respectively, perspective and environmental views of the truck cab and bed lift tool 10 when configured to remove a step-side pickup truck bed 105. The truck cab and bed lift tool 10 enables lifting the step-side pickup truck bed 105 by attaching to particular lifting points along a step-side bed 105. Those points are determined by the manufacturer or by the constraints of the step-side pickup truck bed 105. Once connected along with the step-side bed 105 the truck cab and bed lift tool 10 subsequently lifts off a frame member using a boom hoist 95, or other suitable lifting methods.

The various components of the truck cab and bed lift tool 10 are shown in FIG. 1 outwardly extending for supporting and lifting the outer top edges of a step-side bed 105. The truck cab and bed lift tool 10 includes a main beam 20 which supports telescoping attachments that enable adjustment of lift plate assemblies 60. The lift plate assemblies 60 can be adjusted in the length (X), width (Y), and height (Z) axes to position the lift plate assemblies 60 below the lifting points of the step-side bed 105.

The main beam 20 is envisioned as being made of an open-ended section of hollow structural tubing approximately fifty-eight inches (58 in.) in length and two inches (2 in.) square. These are useful dimensions which support work with standard pickup truck beds. The main beam 20 includes a top, centrally welded lifting ring 22 for attachment of the truck cab and bed lift tool 10 to a hook of an existing hoist 95, 97 (see FIG. 95). The bottom of the main beam 20 is covered with a rubber first pad 24 that is bonded to the main beam 20 using industrial adhesives. This provides protection for the finished surfaces of the pickup truck 100. The main beam 20 enables a first upper extension 30*a* into a first end, and a second upper extension 30*b* into an opposing second end. This supports horizontal length adjustments for the truck cab and bed lift tool 10.

The upper extensions 30*a*, 30*b* each comprise "T"-shaped steel weldments made using square structural tubing and sized to fit snugly within the ends of the main beam 20. The top bar of each "T"-shaped upper extension 30*a*, 30*b* is vertically oriented to provide insertion of a first lower extension 40*a* and a second lower extension 40*b* into respective bottom open ends of each upper extension 30*a*, 30*b*. This provides for vertical adjustments to the truck cab and bed lift tool 10.

The first 40*a* and second 40*b* lower extensions include "T"-shaped weldments made of hollow structural tubing sized to fit snugly within open ends of the upper extension 30*a*, 30*b*. The lower extensions 40*a*, 40*b* include top bars which extend horizontally and perpendicularly outward relative to the main beam 20. Opposing open ends of lower extension 40*a* receives a first outer extension 50*a* and a second outer extension 50*b*, while opposing open ends of the lower extension 40*b* receives a third outer extension 50*c* and a fourth outer extension 50*d*. The outer extensions 50*a*, 50*b*, 50*c*, and 50*d* enables width adjustments for the truck cab and bed lift tool 10.

Each outer extension 50*a*, 50*b*, 50*c*, 50*d* comprises a "T"-shaped structural tube weldment that is oriented along a horizontal plane. The outer extension 50*a*, 50*b*, 50*c*, 50*d* have opposing inwardly directed and outwardly directed open ends that are generally parallel to the main beam 20. The open end of each outer extension member 50*a*, 50*b*, 50*c*, and 50*d* is sized to receive a respective telescoping lift plate assembly 60.

The truck cab and bed lift tool 10 includes four (4) lift plate assemblies 60. Each lift plate assembly 60 provides a horizontal, generally rectangular surface that is designed to mate with a lifting point of the pickup truck body 105 (also the pickup truck bodies 110, 115 shown in FIGS. 4 and 6) during lifting. Each lift plate assembly 60 includes a unitary steel assembly having an extension bar 62 and a steel lifting plate 64 that is approximately four inches by three inches (4×3 in.). Each lifting plate 64 is partially covered with an adhesively bonded rubber second pad 66 which provides protection to the truck body 105 (and pickup truck bodies 110, 115) during lifting.

The truck cab and bed lift tool 10 is highly adjustable in the X-Y-Z axes. The main beam 20 supports "X" axes adjustments using telescoping upper extensions 30*a*, 30*b*. The upper extensions 30*a*, 30*b* support "Z" axes adjustments using telescoping lower extensions 40*a*, 40*b*. The lower extensions 40*a*, 40*b* support "Y" axes adjustments using telescoping outer extensions 50*a*, 50*b*, 50*c*, and 50*d*. The outer extensions 50*a*, 50*b*, 50*c*, 50*d* support "X" axes adjustments using telescoping extension bars 62. Once the various telescoping members are properly adjusted they are locked into place via rows of equally-spaced pin apertures 80 that are drilled or otherwise formed through respective tubular member and the insertion of locking pins 82 into those pin apertures. The locking pins 82 are preferably standard commercially-available quick-connect pin fasteners.

The adjustability of the truck cab and bed lift tool 10 allows a user to position each lift plate assembly 60 in three (3) axes. The upper extensions 30*a*, 30*b* are envisioned as providing approximately eight inches (8 in.) of vertical adjustability. The outer extensions 50*a*, 50*b*, 50*c*, and 50*d* are envisioned as providing approximately twelve inches (12 in.) of lateral adjustability. The inward or outward attachment of the lift plate assemblies 60 to each outer extension 50*a*, 50*b*, 50*c*, and 50*d* may provide 12 inches of adjustability.

Figure 3:
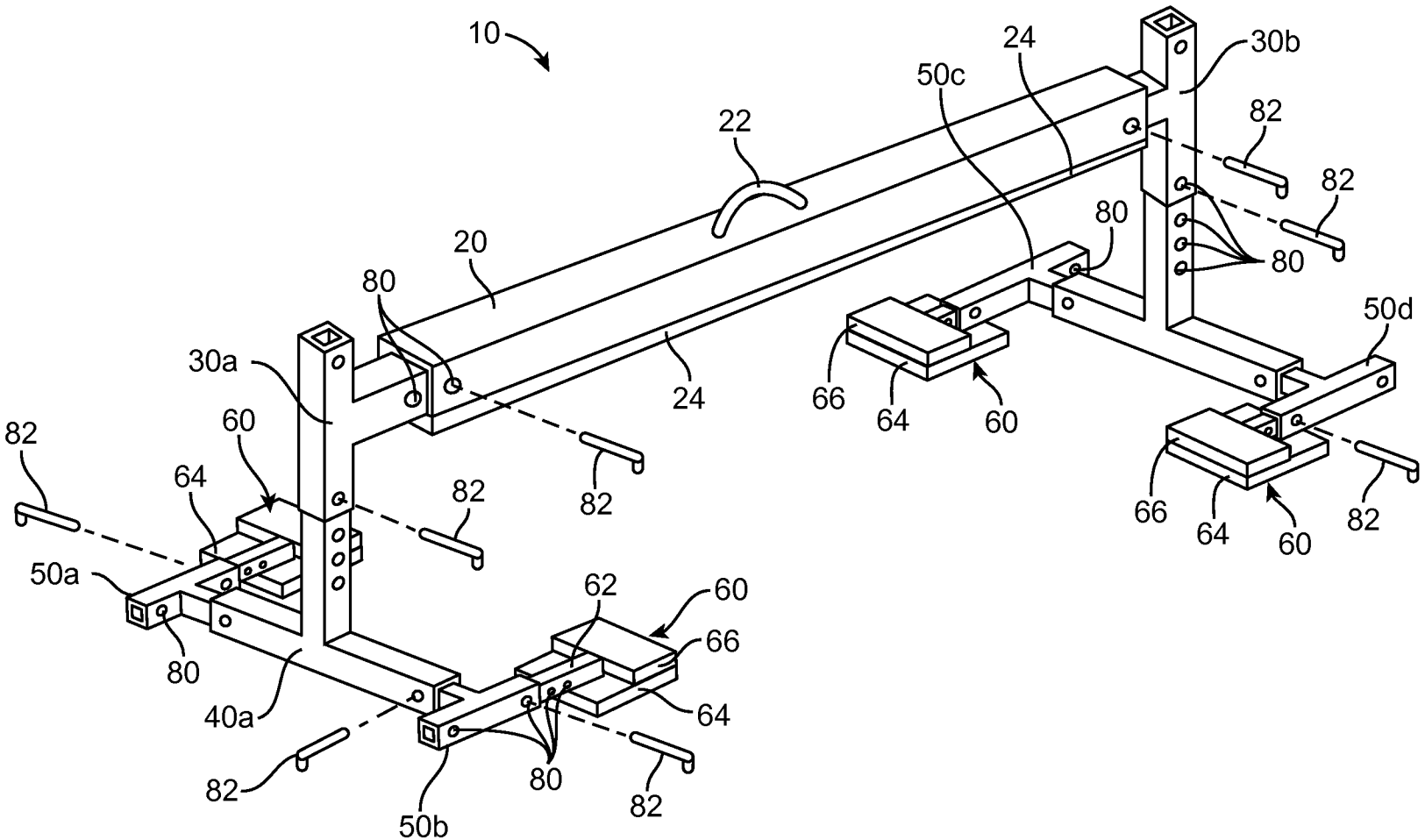
FIG. 3 is a perspective view of the truck cab and bed lift tool 10 generally configured to remove a pickup truck cab.
Figure 4:
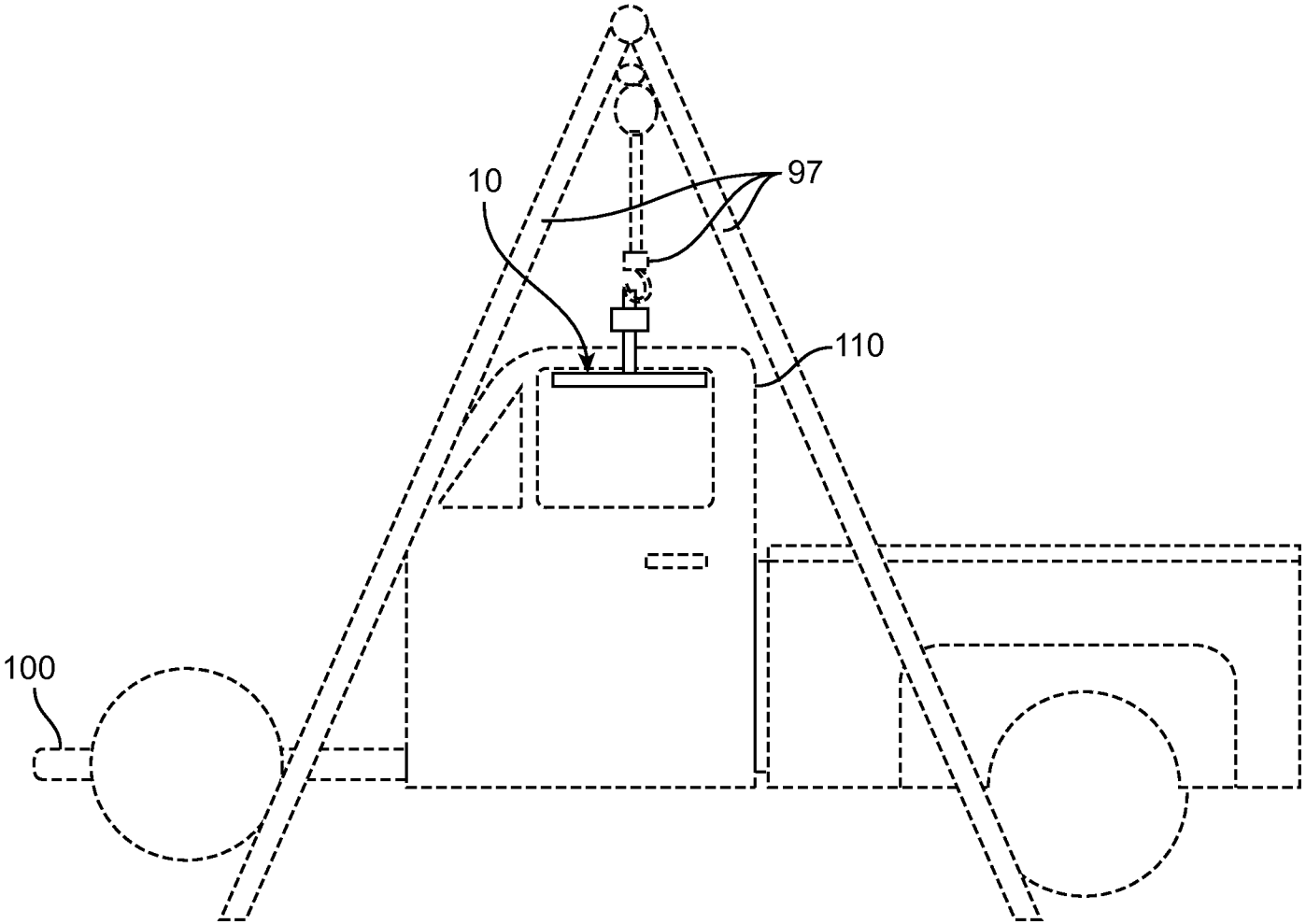
FIG. 4 is an environmental view of the truck cab and bed lift tool 10 removing a pickup truck cab 110.
Figure 5:
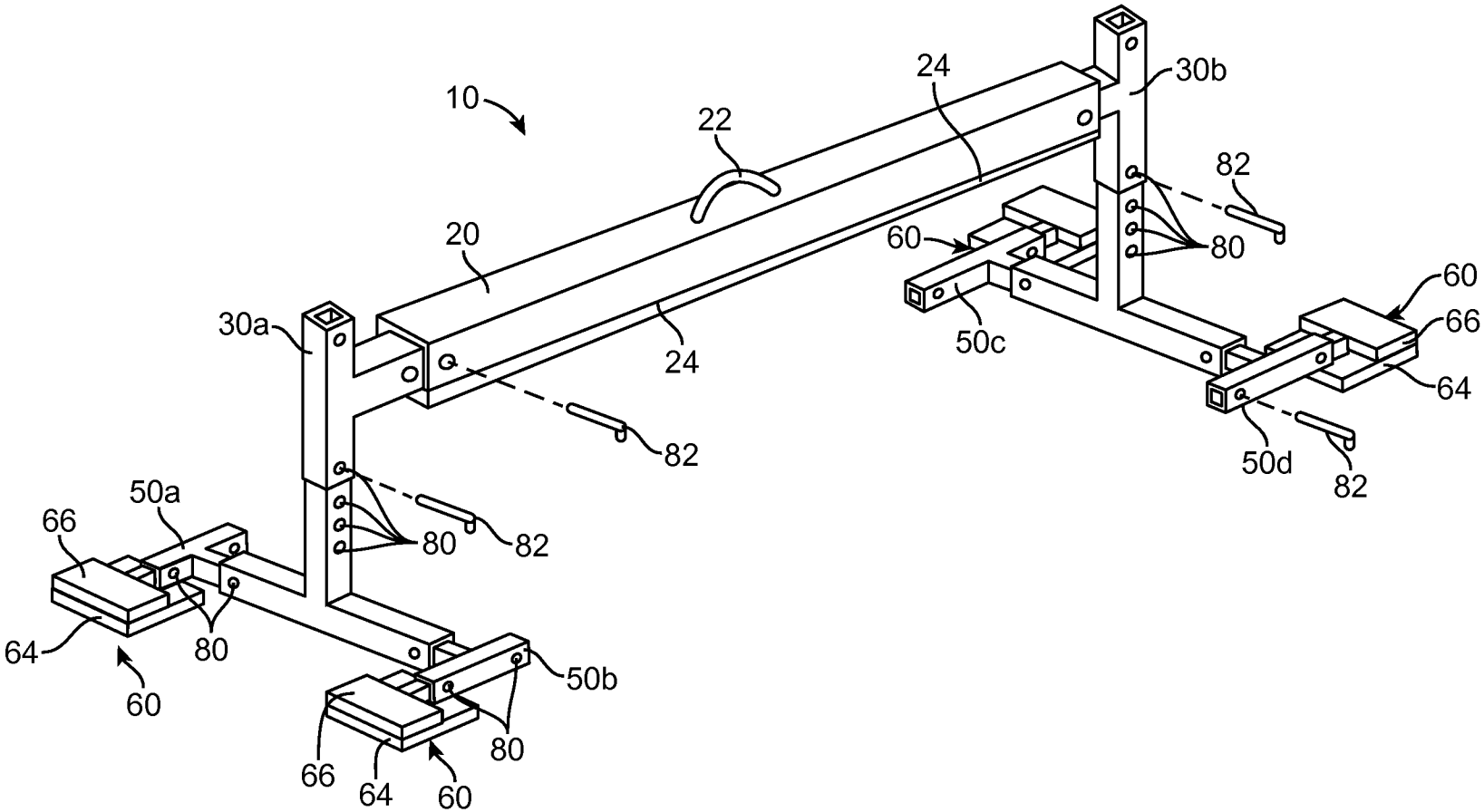
FIG. 5 is a perspective view of the truck cab and bed lift tool 10 generally configured to remove a fleet-side pickup truck bed; and, FIG. 6 is an environmental view of the truck cab and bed lift tool 10 removing a fleet-side pickup truck bed 115.
Figure 6:
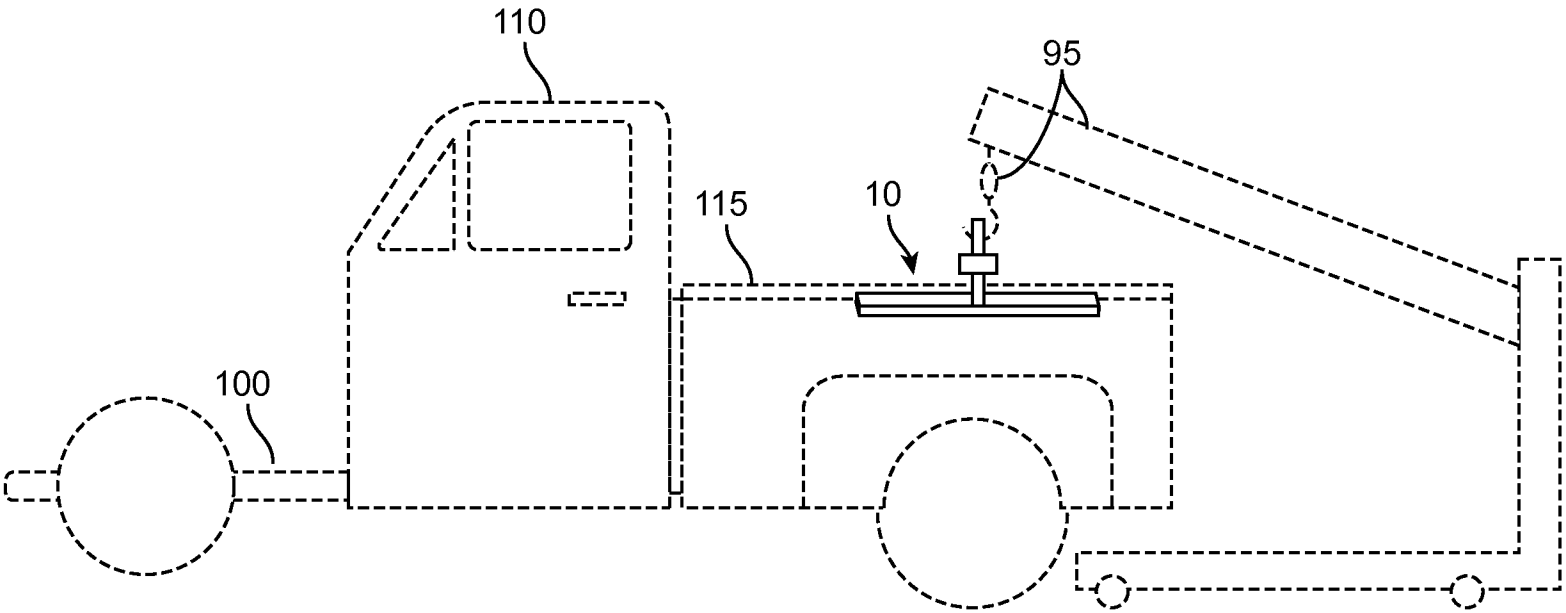

The truck cab and bed lift tool 10 can be easily reconfigured to support and lifting a truck cab 110 as shown in FIGS. 3 and 4 or a fleet-side bed 115 as shown in FIGS. 5 and 6.

Refer now to FIGS. 3 and 4, respectively perspective and environmental views of the truck cab and bed lift tool 10 configured to remove a pickup truck cab 110. The truck cab and bed lift tool 10 is reconfigured by adjusting the positions of the upper extensions 30*a*, 30*b*, lower extensions 40*a*, 40*b*, outer extensions 50*a*, 50*b*, 50*c*, 50*d*, and the lift plate assemblies 60 to mate with particular lifting points along a doorframe of a pickup truck 100. This enables lifting the cab 110 from the frame. The truck cab and bed lift tool 10, along with the cab 110, may then be lifted using a tripod-type hoist 97 as shown, or any other suitable methods of lifting the truck cab and bed lift tool 10 as well as its attached load.

The truck cab and bed lift tool 10 is also suitable for supporting and lifting not only the pickup truck cab 110 but also the edges of door or window frames of a pickup truck 100. The actual positioning of the lift plate assemblies 60 would be based upon the particular model and design of the pickup truck 100 and what is being lifted.

Refer now to FIGS. 5 and 6, respectively perspective and environmental views of the truck cab and bed lift tool 10 removing a fleet-side pickup truck bed 115. The truck cab and bed lift tool 10 is configured with its lift plate assemblies 60 directed outward. This is accomplished by inserting the extension bars 62 into outward-facing open ends of respective outer extension 50*a*, 50*b*, 50*c*, and 50*d*. This configuration allows the lift plate assemblies 60 to contact lift points located along inner top edges of a fleet-side bed 115 to lift the bed 115 off of the frame.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the truck cab and bed lift tool 10, it would be configured as indicated in FIG. 1, 3, or 5 and used as indicated in FIGS. 2, 4, and 6. Of course other configurations can also be used.

The method of installing and utilizing the truck cab and bed lift tool 10 may be achieved by performing the following steps: procuring the truck cab and bed lift tool 10; pre-assembling the truck cab and bed lift tool 10 by inserting the upper extensions 30*a*, 30*b* into ends of the main beam 20; securing the upper extensions 30*a*, 30*b* into a desired position by inserting respective pin fasteners 82 into the pin apertures 80; inserting the lower extensions 40*a*, 40*b* into respective upper extensions 30*a*, 30*b*; securing the lower extensions 40*a*, 40*b* into a desired position by inserting respective pin fasteners 82 into the pin apertures 80; inserting the outer extensions 50*a*, 50*b*, 50*c*, 50*d* into ends of the lower extensions 40*a*, 40*b*; securing the outer extensions 50*a*, 50*b*, 50*c*, 50*d* into a desired position by inserting respective pin fasteners 82 into the pin apertures 80; inserting the extension bars 62 of the lift plate assemblies 60 into respective outer extensions 50*a*, 50*b*, 50*c*, 50*d*; securing the lift plate assemblies 60 into a desired position by inserting respective pin fasteners 82 into the pin apertures 80; positioning the truck cab and bed lift tool 10 above a major body member 105, 10, 115 of the pickup truck 100 by engaging a hook of an existing hoist 95, 97 or other suitable methods of lifting the truck cab and bed lift tool 10 to the lifting ring 22; adjusting the upper extensions 30*a*, 30*b* horizontally, lower extensions 40*a*, 40*b* vertically, outer extensions 50*a*, 50*b*, 50*c*, 50*d* laterally, and the lift plate assemblies 60 inward or outward until the lift plate assemblies 60 are properly positioned below lift point of the body member 105, 110, 115 to be lifted; lifting the body member 105, 110, 115 off the frame of the pickup truck 100 using the hoist 95, 97; and, benefiting from a fully adjustable lift tool truck cab and bed lift tool 10 capable of removing various pickup truck body elements 105, 110, 115 afforded a user of the present invention.

The aforementioned steps are utilized to configure the truck cab and bed lift tool 10 into a desired utility as illustrated in FIGS. 2, 4, and 6. When not in use, the pin fastener portions 82 may be removed from the pin apertures 80 allowing the major elements of the truck cab and bed lift tool 10 to be disassembled and stored in a small area. While intended specifically for use with pickup trucks 100, the truck cab and bed lift tool 10 may be used in like manner on various motor vehicles including automobiles.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A truck cab and bed lift tool, comprising:

a main beam having a first end and a second end;

a "T"-shaped first upper extension adjustably extending horizontally from said first end of said main beam;

a "T"-shaped second upper extension adjustably extending horizontally from said second end of said main beam;

an inverted "T"-shaped first lower extension adjustably extending vertically from said first upper extension;

an inverted "T"-shaped second lower extension adjustably extending vertically from said second upper extension;

a first telescoping outer extension adjustably extending horizontally from a first side of said first lower extension;

a second telescoping outer extension adjustably extending horizontally from a second side of said first lower extension;

a third telescoping outer extension adjustably extending horizontally from a first side of said second lower extension;

a fourth telescoping outer extension adjustably extending horizontally from a second side of said second lower extension;

a first lift plate assembly adjustably extending horizontally from said first telescoping outer extension;

a second lift plate assembly adjustably extending horizontally from said second telescoping outer extension;

a third lift plate assembly adjustably extending horizontally from said third telescoping outer extension; and, a fourth lift plate assembly adjustably extending horizontally from said fourth telescoping outer extension.

2. The truck cab and bed lift tool according to claim 1, wherein said main beam includes a central lifting hook.

3. The truck cab and bed lift tool according to claim 1, wherein said main beam is comprised of open-ended, hollow structural steel tubing.

4. The truck cab and bed lift tool according to claim 3, wherein said first upper extension main beam is comprised of open-ended, hollow structural steel tubing that slides relative to said main beam and that includes a vertically orientated open tube.

5. The truck cab and bed lift tool according to claim 4, further including a plurality of pin apertures disposed in said first upper extension and a pin aperture through said main beam, wherein pin apertures in said first upper extension can align with said pin aperture in said main beam.

6. The truck cab and bed lift tool according to claim 4, further including a first pin fastener passing through aligned pin apertures in said main beam and said first upper extension.

7. The truck cab and bed lift tool according to claim 4, wherein said vertically orientated open tube includes a pin aperture.

8. The truck cab and bed lift tool according to claim 7, wherein said first lower extension includes a plurality of pin apertures that selectively align with said pin aperture through said vertically orientated open tube.

9. The truck cab and bed lift tool according to claim 8, further including a second pin fastener passing through aligned pin apertures in said vertically orientated open tube and said first upper extension.

10. The truck cab and bed lift tool according to claim 1, further including a first rubber pad along the bottom of said main beam.

11. The truck cab and bed lift tool according to claim 1, wherein said main beam is approximately fifty-eight inches long.

12. The truck cab and bed lift tool according to claim 1, wherein said first lift plate assembly provides a horizontal, generally rectangular surface designed to mate with a lifting point of a pickup truck body.

13. The truck cab and bed lift tool according to claim 1, wherein said first lift plate assembly can be adjusted in the X axes, Y axes, and Z axes.

14. The truck cab and bed lift tool according to claim 13, wherein said first lift plate assembly includes a second rubber pad.

* * * * *